US006183836B1

(12) United States Patent
Pflug

(10) Patent No.: US 6,183,836 B1
(45) Date of Patent: Feb. 6, 2001

(54) FOLDED-SHEET HONEYCOMB STRUCTURE

(76) Inventor: Jochen Pflug, Ernst-Gobel-Strasse 35, Wiesbaden, D-65207 (DE)

( * ) Notice: Under 35 U.S.C. 154(b), the term of this patent shall be extended for 0 days.

(21) Appl. No.: 08/983,097

(22) PCT Filed: Jul. 16, 1996

(86) PCT No.: PCT/EP96/03121

§ 371 Date: May 6, 1998

§ 102(e) Date: May 6, 1998

(87) PCT Pub. No.: WO97/03816

PCT Pub. Date: Feb. 6, 1997

(30) Foreign Application Priority Data

| | | |
|---|---|---|
| Jul. 18, 1995 | (DE) | 195 26 189 |
| Jan. 15, 1996 | (DE) | 196 01 172 |
| Feb. 21, 1996 | (DE) | 196 06 195 |

(51) Int. Cl.[7] ..... B31D 3/00
(52) U.S. Cl. ..... 428/116; 428/118; 493/397
(58) Field of Search ..... 428/73, 116, 118; 493/397, 404

(56) References Cited

U.S. PATENT DOCUMENTS

| | | | | |
|---|---|---|---|---|
| 3,292,513 | * | 12/1966 | Palmer . | |
| 3,673,057 | * | 6/1972 | Fairbanks | 161/68 |
| 3,752,089 | * | 8/1973 | Bartels | 108/161 |
| 3,753,843 | * | 8/1973 | Hutchison | 161/43 |
| 3,951,730 | * | 4/1976 | Wennberg et al. | 428/116 |
| 4,001,964 | * | 1/1977 | Hooker . | |
| 4,027,058 | * | 5/1977 | Wotten | 428/116 |
| 4,087,302 | * | 5/1978 | Miller et al. | 224/42.23 |
| 4,090,384 | * | 5/1978 | Wotten | 72/186 |
| 4,197,341 | * | 4/1980 | Rule | 428/116 |
| 4,333,622 | * | 6/1982 | Albano | 248/188.8 |
| 5,389,059 | * | 2/1995 | Corwin | 493/355 |

FOREIGN PATENT DOCUMENTS

| | | | |
|---|---|---|---|
| 196 01 72A1 | * | 1/1997 | (DE) . |
| WO 9402311 | | 2/1994 | (WO) . |
| WO 94/02311 | * | 3/1994 | (WO) . |

* cited by examiner

*Primary Examiner*—Margaret Medley
(74) *Attorney, Agent, or Firm*—Reising, Ethington, Barnes, Kisselle, Learman & McCulloch, P.C.

(57) ABSTRACT

A folded honeycomb, in particular a sandwich core layer, with walls (22) which are arranged in a rectangular or hexagonal configuration and which are perpendicular to the cover layers, for lightweight structures which are formed from a flat body of metal, plastic material, cloth, fiber composite material or paper by the production of cuts and by folding to constitute rectangular corrugations. The folded honeycomb has relatively large connecting surfaces (13, 16) for connection to the cover layers.

48 Claims, 10 Drawing Sheets

FOLDED-SHEET HONEYCOMB STRUCTURE

This application is a 371 of PCT/EP/96/03121 dated Jul. 16, 1996.

The invention relates to folded honeycombs comprising a plurality of cells, processes for the production of the folded honeycombs, and to uses of such folded honeycombs.

Sandwich core layers are usually produced from honeycombs whose cells respectively form equilateral hexagons. The honeycomb layer is provided with cover layers which are glued to the edges of the side portions defining the honeycomb cells. In practice the honeycombs are produced by being cut off a honeycomb block. In regard to the sandwich composite material, the connection of the honeycomb edges to the cover layers is acritical factor, and for that reason relatively thick adhesive layers are used for embedding the honeycomb edges and the viscosity of the adhesive is precisely monitored.

Honeycombs with cover layer portions which are integral with respect to the cell walls are also already known (U.S. Pat. No. 4,197,341). Such honeycombs however must be produced from individual strips, of which two strips are fitted together to form a row of cells, and that requires precise production of the elements of the row of cells.

It is also already known for folded honeycombs to be produced from a flat blank of web material (WO-94/02311= PCT/US93/06872). An embodiment of the folded honeycomb is provided with connecting surfaces for cover layers which however extend over gaps between cell walls between large octagonal cells and smaller hexagonal cells. The other embodiment includes uniformly hexagonal cells but it does not have any connecting surfaces for cover layers.

The object of the present invention is to provide a folded honeycomb having similar cells, which is folded from a flat blank of web material and which affords sufficiently large connecting surfaces for cover layers.

The invention is defined in the claims.

Externally, the novel folded honeycomb differs from the folded honeycomb which is cut from a block, insofar as there are bridging portions which extend transversely with respect to the honeycomb walls and which form connecting surfaces for cover layers. When therefore the folded honeycomb is used as a sandwich core layer, it is possible to achieve a high degree of cylinder peel-off strength in respect of the cover layer, relative to the sandwich core layer.

As the folded honeycomb has differently oriented, perpendicular walls (that is to say walls which are disposed transversely relative to each other), it is relatively stiff and strong in respect of shear in any direction, parallel to the layer.

The connecting surfaces can also be in the form of bridging portions which integrally connect the cell walls together and which thus provide for an additional stiffening effect for the folded honeycomb, transversely with respect to the cell walls.

The bridging portions are defined in the flat blank by cuts and possibly by fold lines. In that respect, it is possible to provide U-shaped cuts and to use the lugs or tabs formed in that way, partly or entirely, as connecting surfaces.

It is also possible to produce wedge-shaped folded honeycombs or honeycombs generally with a profile in respect of height. In that case the strip-shaped portions are made continuously wider or narrower and the boundary cuts defining the strip-shaped portions are curved or are formed along curvatures.

Before the mutually touching corrugation ridges and corrugation dips of the half-honeycomb corrugations are durably connected together, it is possible for the folded honeycomb to be distorted or displaced in itself in order possibly to adapt to curved surfaces. That shape is then so-to-speak frozen by production of the durable connection between the corrugation ridges and the corrugation dips. In that way it is possible to produce shell-like folded honeycombs which have a certain degree of self-supporting capacity. Folded honeycombs of that kind can be further processed to constitute sandwich structure shaped portions, it is also possible for the honeycomb to be used in crash structures.

To produce the folded honeycomb, the web material is provided with cuts and folded, and that can be implemented by a rolling procedure. Inexpensive manufacture is therefore to be expected. When using conventional paper or cardboard as the starting material therefore a folded honeycomb is considered for use as a packaging material.

Embodiments of the invention are described with reference to the drawings in which.

Figure 3:
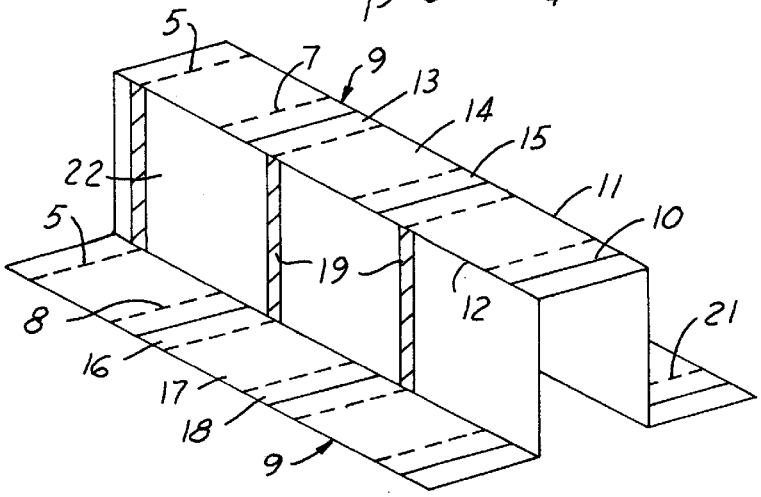
Figure 4:
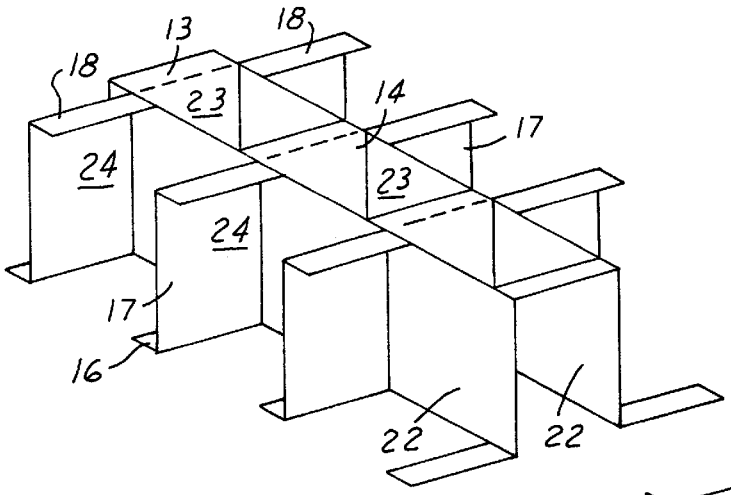
Figure 5:
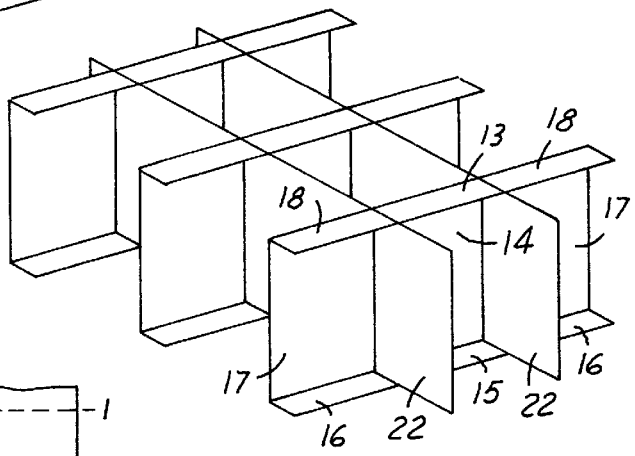
Figure 6:
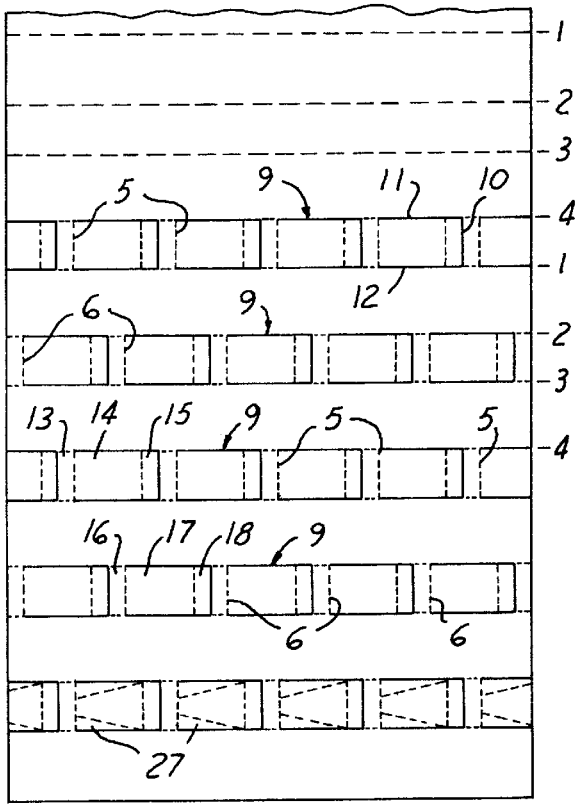
Figure 7:
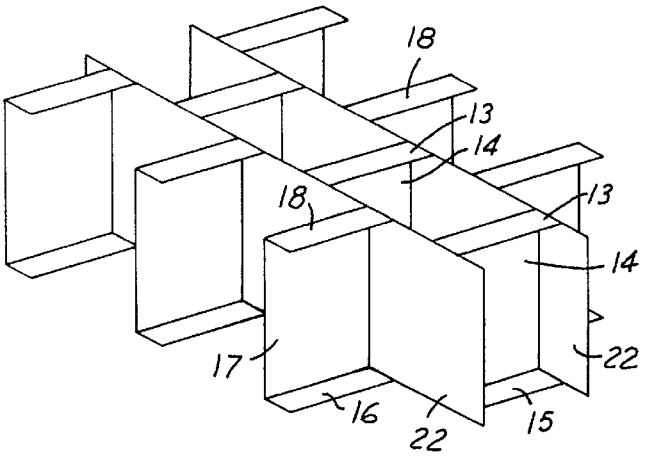
Figure 8:
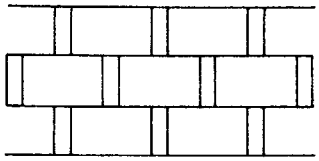
Figure 9:
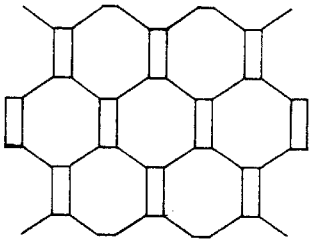
Figure 10:
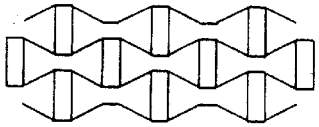
Figure 11:
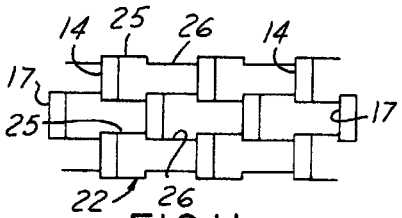
Figure 12:
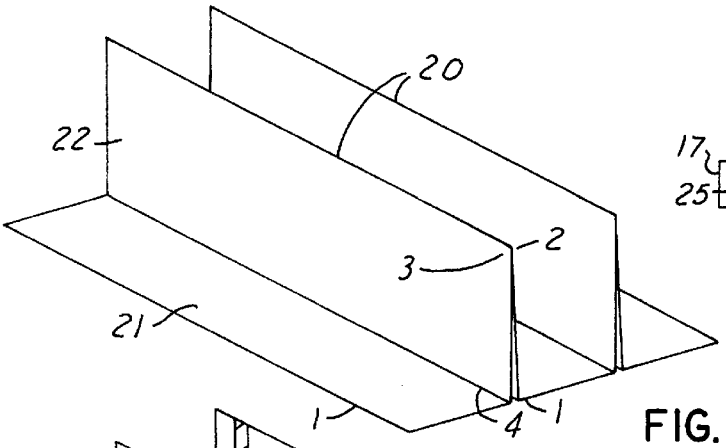
Figure 13:
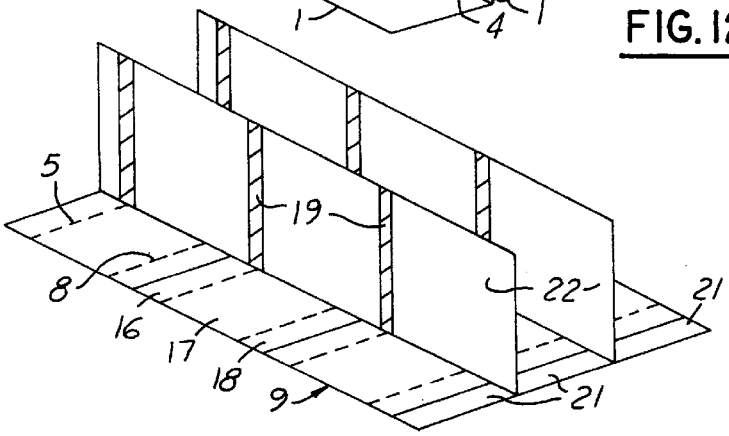
Figure 14:
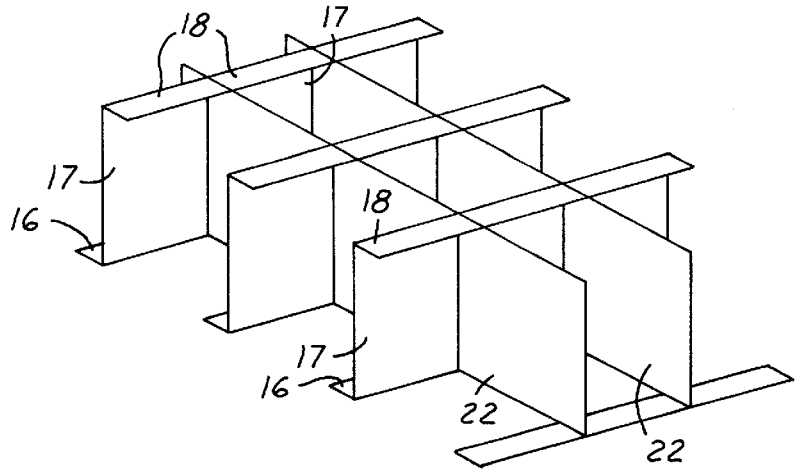
Figure 15:
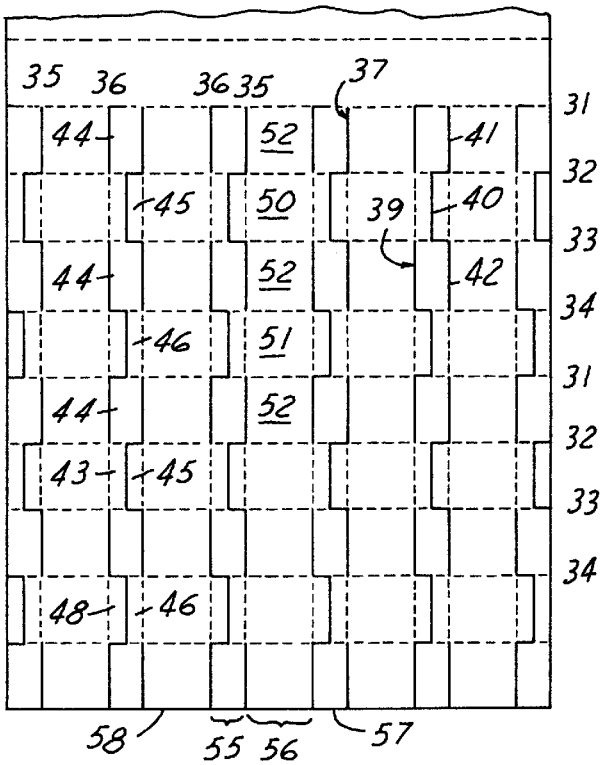
Figure 16:
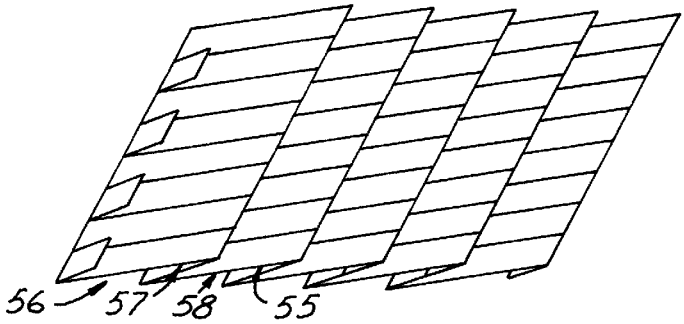
Figure 17:
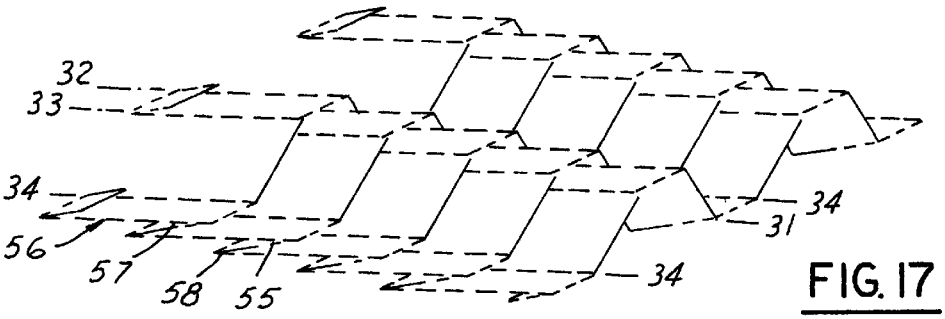
Figure 18:
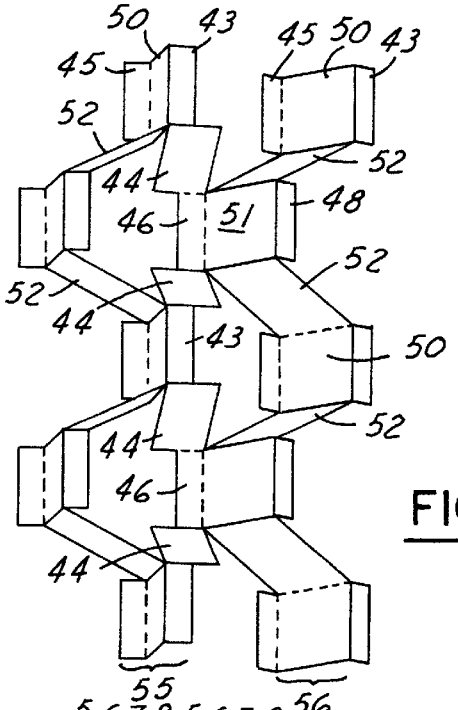
Figure 19:
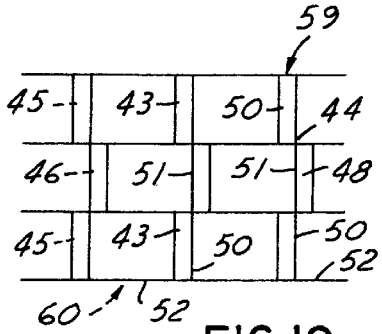
Figure 20:
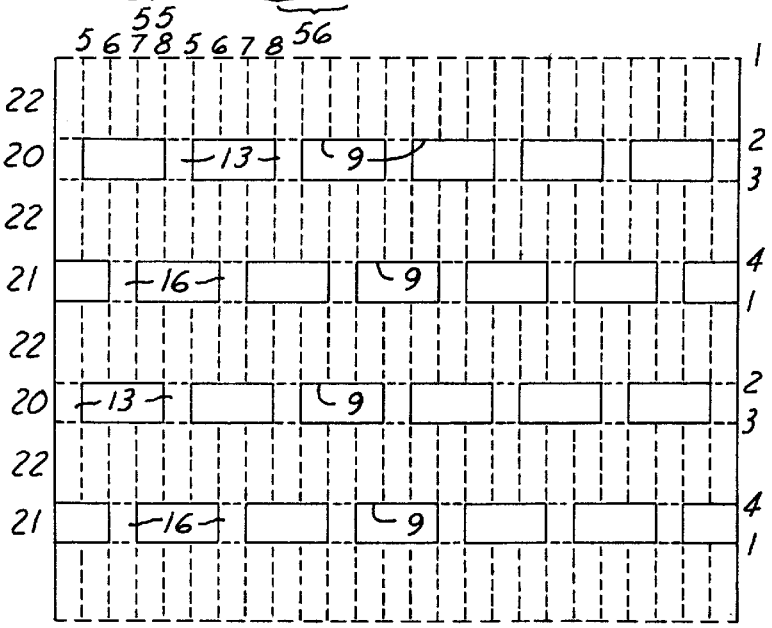
Figure 21:
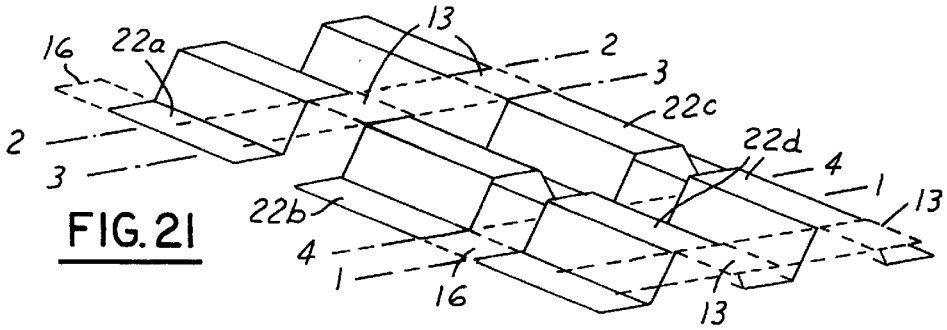
Figure 22:
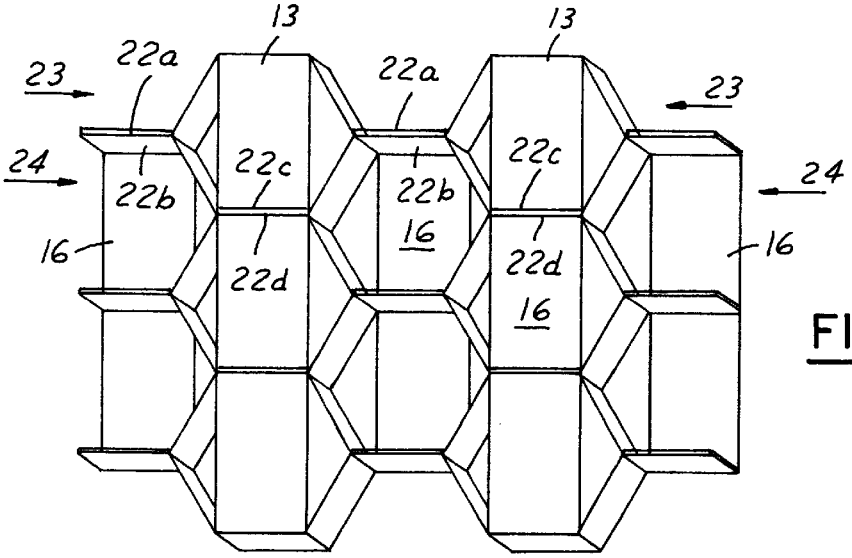
Figure 23:
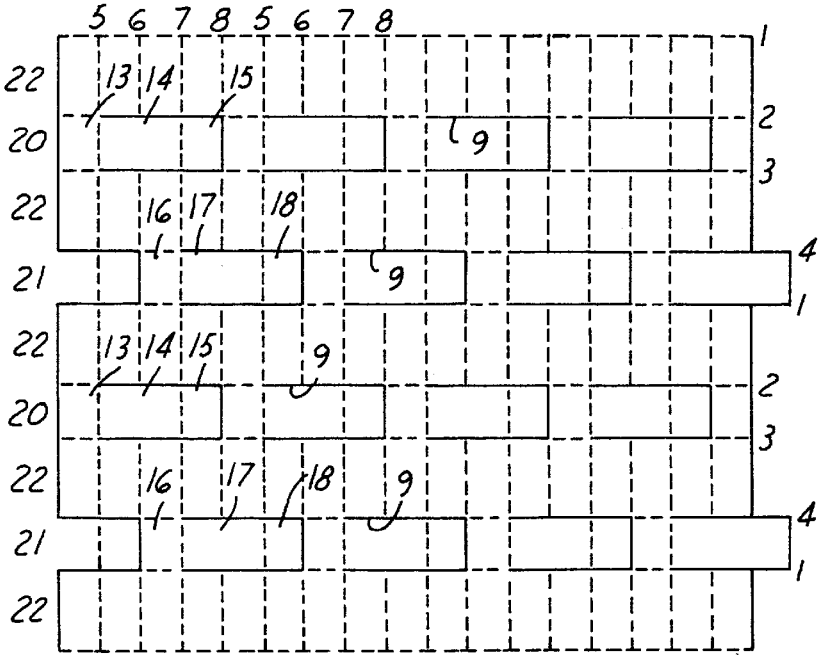
Figure 24:
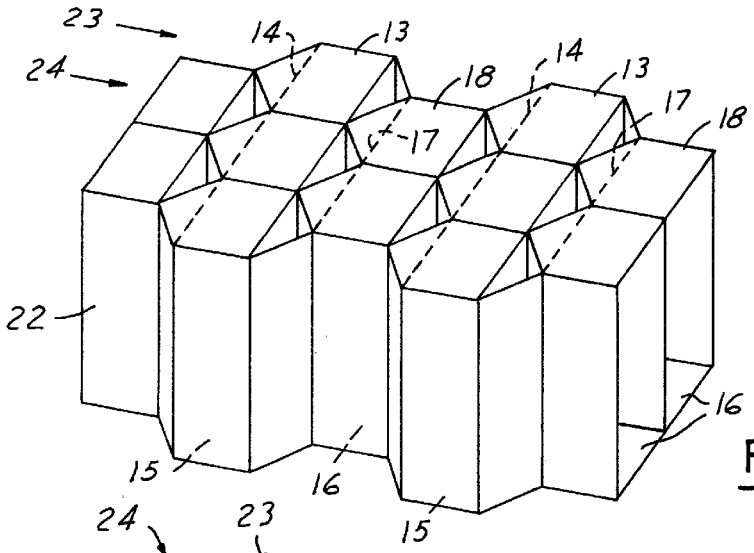
Figure 25:
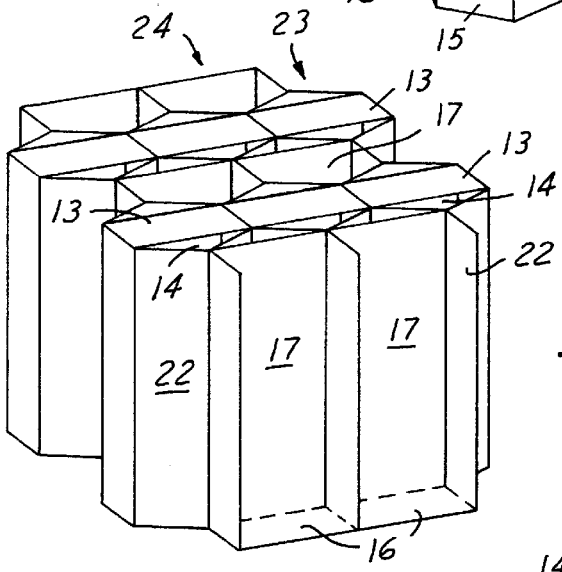
Figure 26:
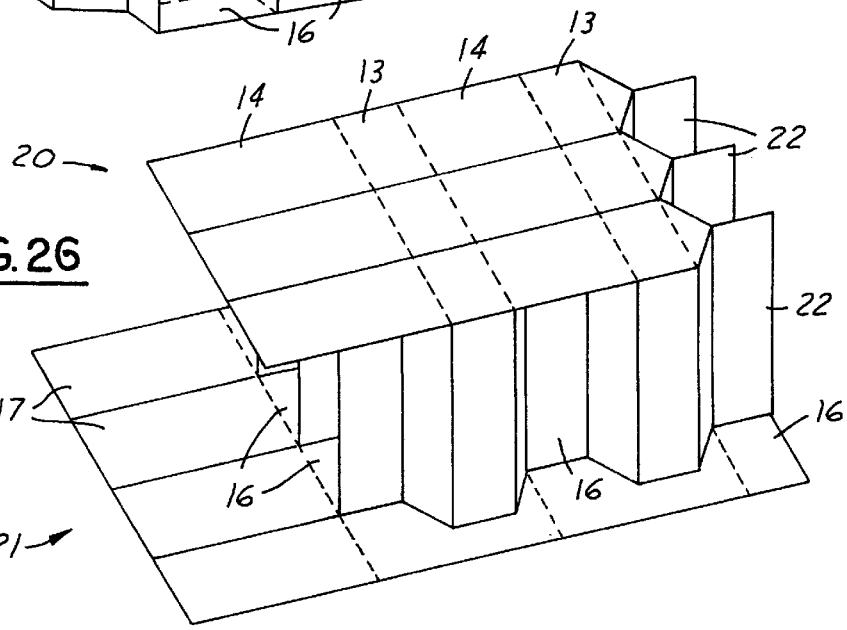
Figure 27:
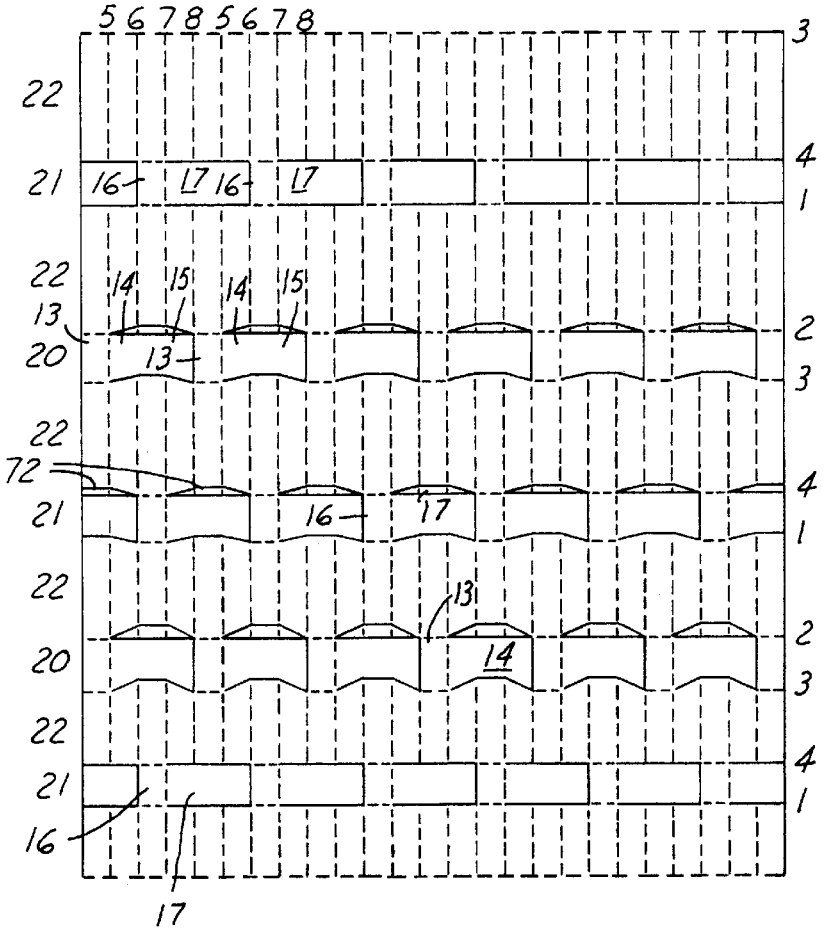
Figure 29:
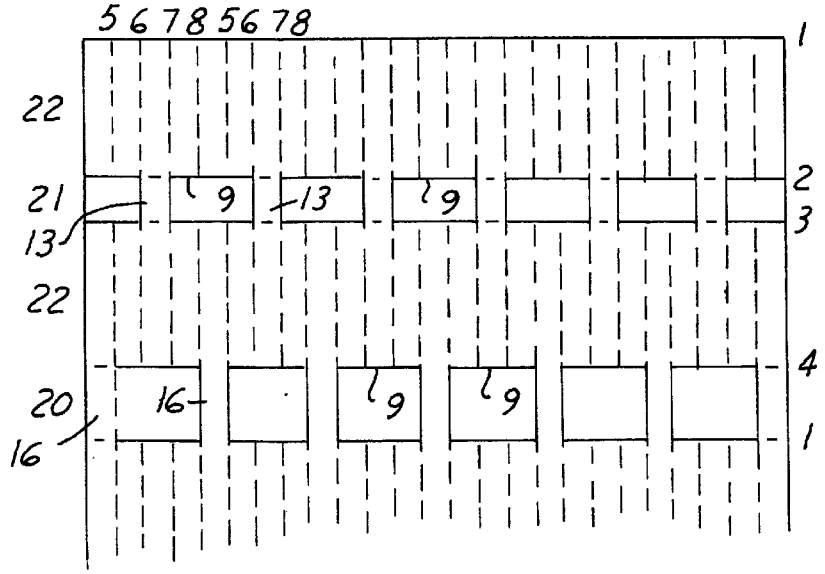
Figure 28:
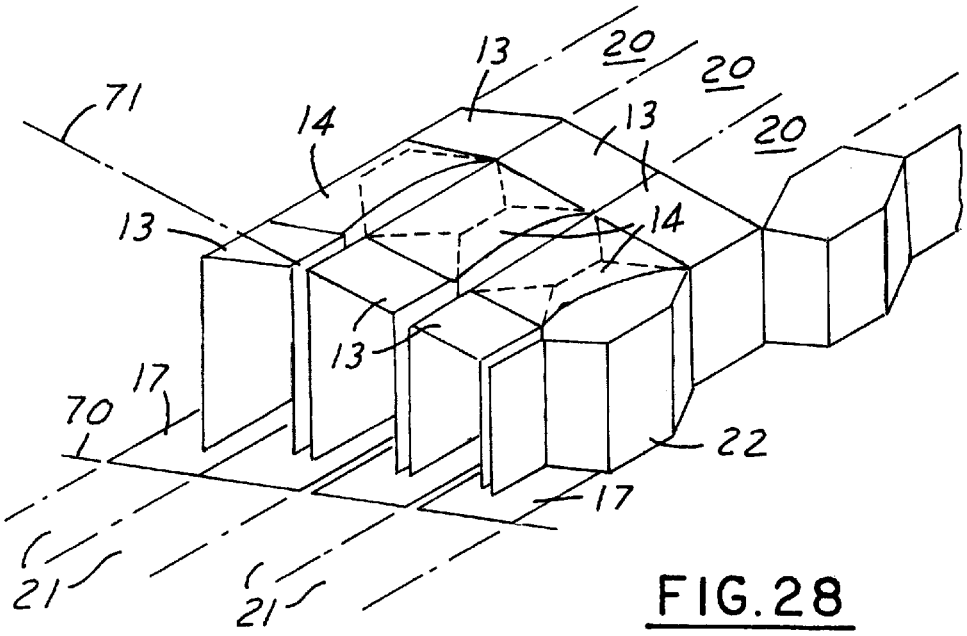
Figure 30:
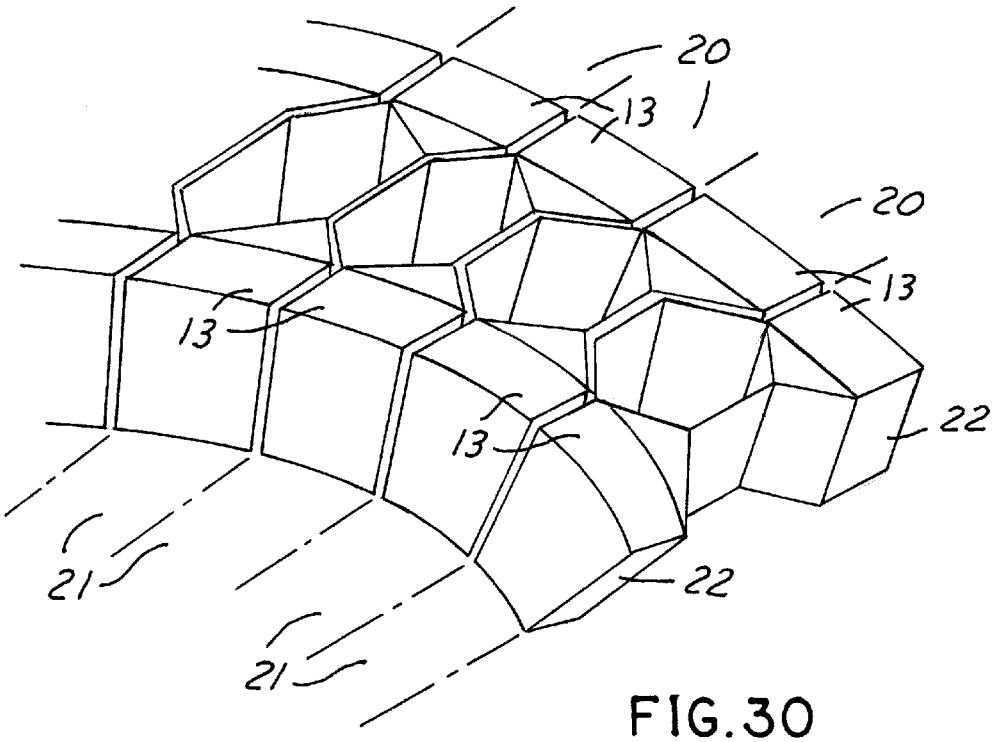
Figure 31:
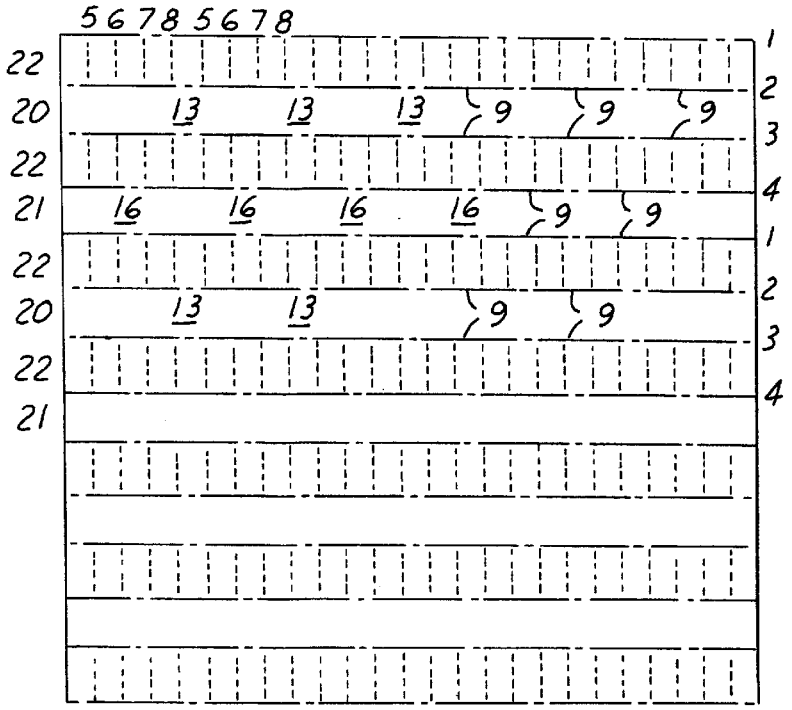
Figure 32:
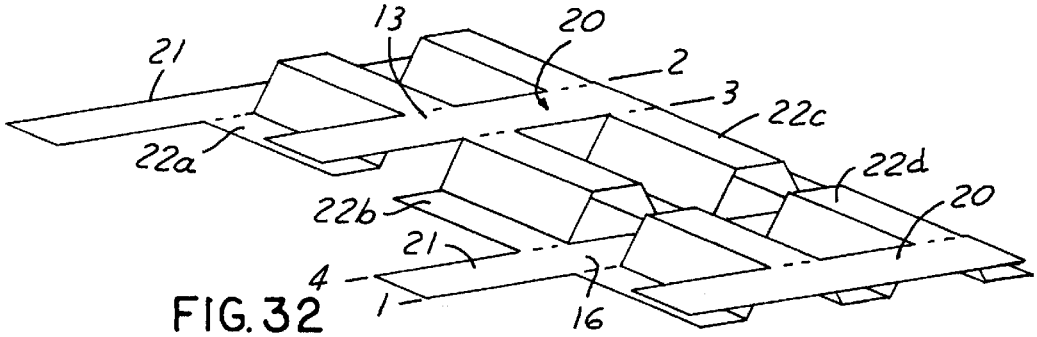
Figure 33:
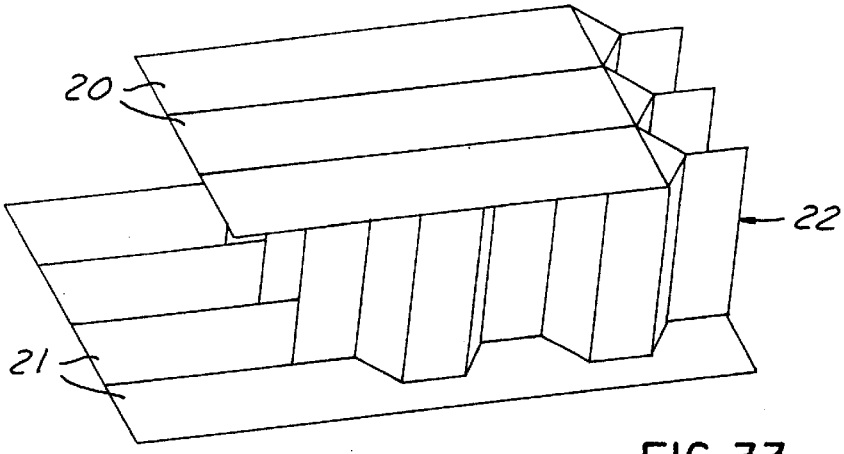

FIG. 3 shows the rectangular corrugation configuration with a pattern of cuts, FIG. 4 shows a pespective view of a folded honeycomb, FIG. 5 shows a rectangle-cross folded honeycomb, FIG. 6 shows a further flat blank with fold lines and U-shaped cuts therein, FIG. 7 shows a perspective view of a folded honeycomb which can be obtained from the flat blank shown in FIG. 6, FIG. 8 is a diagrammatic view of a rectangle-folded honeycomb, FIG. 9 shows the honeycomb of FIG. 8 after expansion, FIG. 10 shows the honeycomb of FIG. 8 after contraction, FIG. 11 shows the FIG. 8 honeycomb with side limb portion folding, FIG. 12 shows a pulse-shaped rectangular corrugation, FIG. 13 shows the pulse-shaped rectangular corrugation with a pattern of cuts, FIG. 14 shows a perspective view of a rectangle-cross folded honeycomb, produced as shown in FIGS. 12 and 13, FIG. 15 shows a further flat blank with fold lines and cuts therein, FIG. 16 shows a first folding of the flat blank shown in FIG. 15, FIG. 17 shows a further folding of the blank, FIG. 18 shows a perspective view of a detail, FIG. 19 shows a folded honeycomb which can be obtained from the blank shown in FIG. 15, FIG. 20 shows a further flat blank with fold lines and cut-outs, FIG. 21 shows an intermediate condition in production, FIG. 22 shows a hexagonal folded honeycomb, produced as shown in FIGS. 20 and 21, FIG. 23 shows a further flat blank with fold lines and cuts therein, FIG. 24 shows a view of a portion on an enlarged scale of a folded honeycomb which has been produced from the material shown in FIG. 23, FIG. 25 is a perspective view on an enlarged scale of a modified folded honeycomb, FIG. 26 is a perspective view on an enlarged scale of a further folded honeycomb made from modified material, FIG. 27 shows a blank for wedge-shaped honeycombs, FIG. 28 is a perspective view on an enlarged scale of a folded honeycomb, produced from the material of FIG. 27, FIG. 29 shows a blank for curved honeycombs, FIG. 30 shows a perspective view of a curved honeycomb, produced from the material of FIG. 29, FIG. 31 shows a further flat blank with fold lines and cuts therein, FIG. 32 shows an intermediate condition in production, and FIG. 33 shows a hexagonal folded honeycomb, produced as shown in FIGS. 31 and 32.

Figure 1:
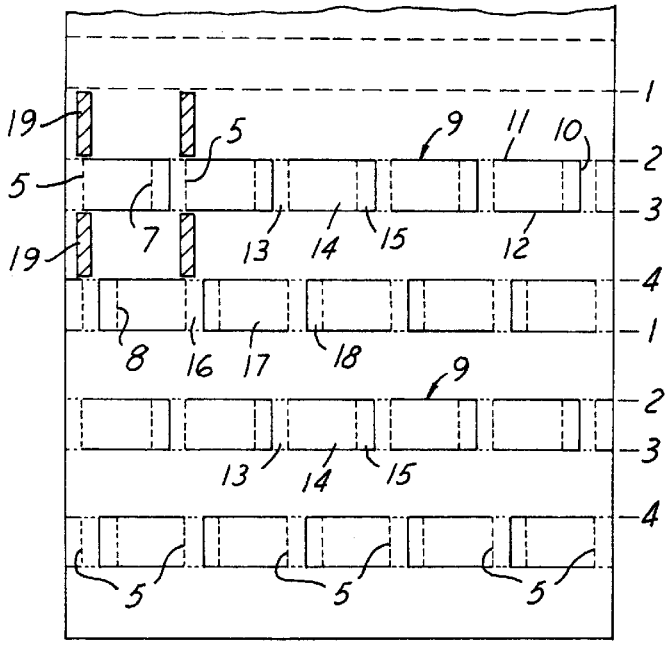
FIG. 1 shows a flat blank with fold lines and U-shaped cuts.

Referring to FIG. 1, shown therein is a flat web of thin metal sheet, plastic material, cloth, fiber-composite material (with carbon, aramide or glass fibers) or fiber-reinforced paper (Nomex$^R$-paper) which, after folding, forms a sandwich core layer in accordance with the invention. For illustrative purposes the fold locations which are folded in the course of the processing procedure are shown in broken line in the web of material. More specifically the Figure shows continuous horizontal fold lines 1, 2, 3, 4 and interrupted, perpendicular fold lines 5 and further fold lines 7, 8. To prepare for the processing procedure, adhesive or solder material strips 19 can also be disposed in alignment with the fold lines 5 on both sides of the web. The fold locations can also be the invention. For illustrative purposes the fold locations which are folded in the course of the processing procedure are shown in broken line in the web of material. More specifically the Figure shows continuous horizontal fold lines 1, 2, 3, 4 and interrupted, perpendicular fold lines 5 and further fold lines 7, 8. To prepare for the processing procedure, adhesive or solder material strips 19 can also be disposed in alignment with the fold lines 5 on both sides of the web. The fold locations can also be prepared, by virtue of stamped or impressed lines. The Figure also shows rows of U-shaped cuts 9, the limbs 11, 12 of which coincide with the horizontal fold lines 4, 1 and 2, 3 respectively while the base 10 of the U-shape extends parallel to the fold lines 5, 7. Those U-shaped cuts 9 can be produced before, during or after the operation of folding the material around the fold lines 1, 2, 3 and 4, in which respect stamping is preferred. The U-shaped cuts 9 enclose respective layer lugs or tabs which are to be bent out of the plane of the web, into the sandwich core layer which is to be formed. As can be seen, the ends of the limbs 11, 12 respectively coincide with the fold lines 5, while towards the adjacent base 10 there is formed a respective connecting surface 13 or 16, the significance of which will be described hereinafter. The layer lugs or tabs within the respective U-shaped cuts 9 have portions 14, 15 and portions 17, 18 which are separated from each other by the fold lines 7 and 8 respectively. The portions 14, 17 are provided to form side leg walls and are initially of a lug-like or tab-like configuration, for which reason those portions are also referred to as side leg lugs or tabs 14, 17.

Figure 2:
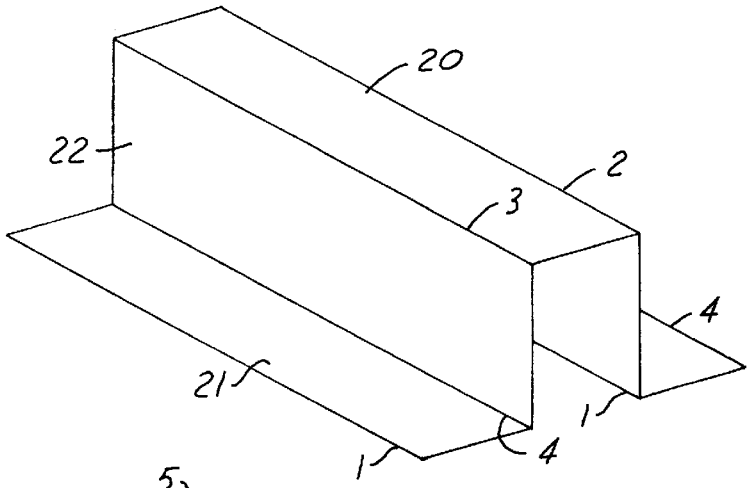
FIG. 2 shows a rectangular corrugation configuration.

FIG. 2 shows a rectangular corrugation, as can be produced from a part of the web shown in FIG. 1. Suitable tools for that purpose are stamping or punching tools or rollers which gradually pull in the web of material without the material suffering from tearing, by virtue of the reduction in length of the web. As will be seen from the drawing, corrugation crest surfaces 20, corrugation trough surfaces 21 and side leg surfaces 22 are formed between the fold lines 1 through 4. FIG. 3 also shows in the rectangular corrugation the U-shaped cuts 9 and the fold lines 7, 8, from which it will be seen that the side leg surfaces 22 remain unchanged in the sandwich core layer while the corrugation crest surfaces 20 are subdivided into the connecting surfaces 13 and the side leg lugs or tabs 14 with tongue or flange surfaces 15 and the corrugation trough surfaces 21 are subdivided into the connecting surfaces 16 and the side leg lugs or tabs 17 with tongue or flange surfaces 18.

To form the folded honeycomb shown in FIG. 4, the portions 14+15 are bent downwardly about the fold lines 5 and the portion 15 is bent upwardly about the fold line 7. Therefore, of the original corrugation crest surface 20, all that remains is the connecting surface 13, disposed in the plane of the corrugation crest. A similar procedure is adopted in regard to the corrugation trough surfaces 21. The portions 17+18 are folded upwardly and the portion 18 is then bent back into a horizontal position. Pressing punch-dies with a top tool and a bottom tool can be used as the tooling for those bending and folding procedures. Provided on the top tool are finger-like bending pushing members which bend the lugs or tabs 14, 15 downwardly until reaching the lower die at which the tongue or flange 15 is bent into a horizontal position. Also provided on the lower tool are finger-like bending pushing members which bend the lugs or tabs 17, 18 upwardly until reaching the upper die where the tongue or flange 18 is bent into a horizontal position. The finger-like bending pushing members fill the spaces 23 and 24 which are formed between the side leg walls 22 and 14, 22 and 17 respectively, before they are pulled back. Due to the folding and bending effects, the cut edges 11 and 12 come into contact with the side leg surface 22 and can be connected thereto by suitable measures, for example by means of the adhesive or solder material strips 19. As will be apparent, the folded honeycomb affords relatively large connecting surfaces 13 and 16 and tongue surfaces 15, 18 for the connection of cover layers so that it is possible easily to produce a shear-resistant composite structure.

In the embodiment shown in FIG. 4 the connecting surfaces 13 and the tongue surfaces 18 extend towards different sides, while it is also possible to select the same folding side, as is shown in FIG. 5. In that case the tongues 15, 18 are firstly not bent by the bending pushing members, but rather that is only effected in a separate step when the bending pushing members are retracted. Alternatively it is possible to use different sets of bending pushing members (which are also pivotable) in order to produce the illustrated folded structure. The honeycomb cells form the differently oriented, perpendicular walls from the side leg surfaces 22 and the side leg lugs or tabs 14, 17. There are connecting surfaces 13, 18 and 15, 16 both on the top side and also on the underside.

If the cut edges 11, 12 are not connected (bonded) to the side leg walls 22 which touch them, by gluing, soldering or welding, that affords a rather reduced level of shear strength in the sandwich structure which comprises the sandwich core layer and the cover layers bonded thereto. That low level of strength is adequate for many uses. Preferably the cut edges 11, 12 are bonded to the side leg walls in order to obtain the maximum level of stiffness and strength in respect of shear.

FIG. 6 shows a modification of the cutting and folding pattern, in comparison with that shown in FIG. 1. Instead of a single vertical array of fold lines 5 for the perpendicular side leg lugs or tabs 14, 17, this arrangement now has two mutually displaced arrays of fold lines 5 and 6. As can be seen, the U-shaped cuts 9 are displaced relative to each other, from one row to another. As a modification in relation to FIG. 1 and in conformity with FIG. 3, the U-shaped cuts 9 are open towards the left, that is to say the fold line 5 or 6 is always arranged to the left of the associated U-shaped cut 9. That represents a possible variation which can be important in regard to production of the honeycomb.

The honeycomb body shown in FIG. 7 was produced on the basis of the cut and fold pattern illustrated in FIG. 6. In the FIG. 7 honeycomb the tongues or flanges 15 or 18 which would be in the way of the finger-like bending pushing members are subsequently folded over.

FIG. 8 shows a view of the honeycomb from above. The side leg walls 22 can be shaped in a corrugated configuration, more specifically either by the rectangular folded honeycomb structure being pulled apart or by the folded honeycomb structure being compressed in rows. After expansion, the result obtained is a pattern which is similar to an octagonal-type honeycomb configuration, as shown in FIG. 9. After contraction, the result obtained is a fish joint-like pattern, as shown in FIG. 10. In the case of the octagonal-type honeycomb configuration, the weight of the honeycomb is reduced. The fish joint-type shape affords more flexibility, more specifically in both surface directions. This honeycomb shape is therefore particularly suitable for parts involving double curvature. It will be appreciated that, according to the requirements involved, different cell widths, densities and thicknesses for the sandwich cores to be produced can be achieved by expansion and contraction.

As FIG. 11 shows, the side leg walls 22 can also be folded with displaced portions as indicated at 25, 26. By virtue of that arrangement, regions of the side leg walls 22 bear snugly against the edge regions of the side leg walls 14, 17 so as to afford a union which involves surface area contact between those mutually perpendicular side leg walls.

There are also possible ways of increasing the size of the connecting surfaces between the cover layers and the sandwich core layer, by providing edge strip surfaces at the upper and lower cut edges of the side leg walls 22.

One of those options involves making the U-shaped cuts 9 in the manner shown in the bottom line in FIG. 6, that is to say with an acute angle between the base 10 and the respective limb 11, 12 so that, of the corrugation crest surfaces 20 or the corrugation trough surfaces 21, there remain triangular surfaces 27 which can be used as connecting surfaces for the cover layers. It will be appreciated that the side leg walls 22 can be deformed towards the somewhat tapering side leg wall regions 14, 17 in order to be connected (bonded) thereto along the adhesive, solder or weld locations 19.

A further option is afforded when using cloth or fabric as the material for the folded honeycomb. Cloth or fabric can be so-to-speak deformed in the plane thereof so that it is possible to produce, at the upper and lower cut edges 11, 12, bent-over marginal portions which can be fixed by impregnation material for the cloth or fabric.

If the fold lines 1, 4 and 2, 3 are not parallel, that gives sandwich core layers of varying thicknesses. The cuts 9 are adapted to the different thicknesses of the core layer. Possibly, the structure obtained can be stretched on the thicker side and compressed at the thinner side, in order to produce uniform width.

To produce the folded honeycomb, it is possible to have recourse to a combined rolling and stamping procedure with interlocking steps. In the production of the sandwich core layer with bonded cut edges, the following steps are involved:

a) a web of the prescribed material is provided;

b) U-shaped cuts 9 are produced in rows in order to form side leg lugs or tabs which are separated from each other by connecting surfaces 13, 16;

c) the web is folded into rectangular corrugations in order to form corrugation crest surfaces 20, corrugation trough surfaces 21 and side leg surfaces 22;

d) the side leg lugs or tabs 14, 17 are folded out of the respective plane of the corrugation crest or corrugation trough respectively, with the connecting surfaces 13, 16 remaining in those planes. The free ends of the side leg lugs or tabs are bent over to form further tongue or connecting surfaces 15, 18;

e) the cut edges 11, 12 are fixedly connected (bonded) to the side leg surfaces 22. The connecting procedure depends on the material used for the flat web of which the sandwich core layer is made. Adhesive, soldering and welding falls to be considered here.

FIG. 12 shows a limit shape in respect of a rectangular corrugation which assumes a pulse-like character. The corrugation crest surface 20 is extremely narrow, that is to say the fold lines 2, 3 are merged together. Accordingly, only regions of the corrugation trough surface 21 are provided with U-shaped cuts, as indicated in FIG. 13. After the side leg lugs or tabs are folded out, the result is the structure shown in FIG. 14.

FIG. 15 shows a further flat web with a cutting and folding pattern. There are horizontal fold lines 31, 32, 33 and 34 and perpendicular fold lines 35 and 36 which form a grid configuration. There are also two mutually displaced arrays of meander-shaped cuts 37 and 39 which each have a central portion 40 and two lateral portions 41, 42. The central portion 40 extends in each case centrally with respect to the adjacent lines 35, 36. By virtue thereof, connecting surfaces 43 and 45 are formed between the horizontal fold lines 32, 33 while connecting surfaces 46 and 48 are formed between the fold lines 34 and 31. In the narrower strip 55 and 57 between the lines 35 and 36, there are also areas 44 which will form parts of the side leg walls, as will also be described. Between the arrays of the fold lines 35 and 36 there are also wider strips 56 and 58 which are subdivided into square areas 50, 51, 52.

The web shown in FIG. 15 is folded in a zig-zag shape, as illustrated in FIG. 16. The wider strips 56, 58 are displaced relative to each other by the dimension of the narrower strips 57, 58 and overlap each other by that dimension.

In a further step, the folded structure in FIG. 16 is folded in a corrugation-like configuration transversely with respect to the strips about the fold lines 31, 32, 33 and 34, in which case in the final condition rectangular corrugations are produced, while retaining the overlapping structure illustrated in FIG. 16. The structure in FIG. 17 is then pulled apart, in which case there are rotary movements about the fold edges, with the result that the cut edges 41, 42 are oriented perpendicularly and the cut edges 40 are oriented horizontally in the sandwich core layer. In that respect, the edges 41, 42 come into contact with the areas 50, 51 and 52 and can be connected thereto by adhesive, soldering or welding. By moving the structure back, it is also possible to achieve a certain degree of surface overlap in relation to leg regions in respect of the areas 44 and 52, whereby the quality of the connection can be improved.

FIG. 18 is a perspective view of a portion from the sandwich core layer in a condition immediately before the surfaces adopt their definitive position, but being shown as being pulled apart somewhat, for the sake of simplicity of illustration. In practice the illustrated structure is upset or compressed whereby the areas 50, 52, 51, 52, 50 and so forth belong to side leg walls in the form of a rectangular corrugation and the areas 44 are oriented perpendicularly and in alignment with the side leg walls 52. Such surfaces are therefore connected together. That is shown in FIG. 19 which is a view on to the sandwich core layer from above.

The sandwich core layer comprises narrower and wider strips 55, 56, 57, 58 which are connected together at least along the fold edges 36 in respect of the regions 43 and the fold edges 32 or 34 in respect of the areas 44. The narrower strips 55, 57 form rectangular corrugations perpendicularly to the plane of the sandwich core layer and the wider strips 56, 58 form rectangular corrugations in that sandwich core layer. In that situation, the surfaces 43 represent corrugation crests of the strip 55 and the surfaces 46 represent corrugation troughs of the strip 55, to which however there are joined the surfaces 48 as corrugation crests and the surfaces 45 as corrugation troughs of the adjoining strip 57, in order to form a topside connecting strip 59 (FIG. 19) with the surfaces 43, 44 arranged in displaced relationship, and a bottom-side connecting strip 60 also with surfaces 45, 46 arranged in displaced relationship. The flanks 44 of the rectangular corrugations of the narrower strips 55 and 57 and the flanks 52 of the rectangular corrugations of the wider strips 56, 58 lie in the sandwich core layer and there form side leg walls or parts thereof.

The hexagonal folded honeycombs described hereinafter are produced as above from flat or even bodies, for example thin metal sheet, plastic foil or film, cloth or fabric, fiber composite material in web form (with carbon, aramide or glass fibers) or fiber-reinforced paper (Nomex$^R$-paper), but normal paper or cardboard can also be considered. The flat material is provided with cuts and then serves as a starting material for the folding procedure.

FIG. 20 shows a flat web with periods of horizontal fold lines 1, 2, 3, 4 and periods of perpendicular fold lines 5, 6, 7, 8. The fold locations can be prepared by stamped or embossed lines. Provided between the fold lines 2, 3 and 4, 1 are cuts 9 which, in the case shown in FIG. 1, cut out a rectangular region. The cuts 9 can be slightly prolonged in the direction of the fold lines 5, 8 and 6, 7 respectively. Such cuts can be produced by stamping.

Formed between the fold lines 2 and 3 are interrupted, strip-shaped regions 20 which, besides the above-mentioned cuts 9, also include bridging portions 13, while formed between the fold lines 4 and 1 are interrupted, strip-shaped regions 21 which, besides the cuts 9, also include bridging portions 16. Disposed between the interrupted, strip-shaped regions 20 and 21 are continuous, strip-shaped regions 22 through which the periodic fold lines 5, 6, 7 and 8 pass. As will be apparent, the strip-shaped regions 22 are connected together by way of the bridging portions 13 and 16 respectively so that the material which is prepared for the folding procedure comprises a continuous flat body.

The flat body shown in FIG. 20 can be folded in two mutually perpendicular directions, and more specifically rectangular corrugation configurations can be produced, wherein the strip-shaped regions 20 form the corrugation crests, the strip-shaped regions 21 form the corrugation troughs and the strip-shaped regions 22 form the corrugation flanks. The corrugation effect in the direction perpendicular thereto is produced by bending or partial folding about the fold lines 5 through 8, which is referred to herein as "pleating". Trapezoidal corrugations are produced, which are referred to herein as "half-honeycomb corrugations with corrugation ridges and corrugation dips".

FIG. 21 shows an intermediate shape with half-honeycomb corrugations comprising three strip-shaped regions 22. As will be apparent, the material in FIG. 20 is pleated in such a way that the bridging portions 13 are aligned with the corrugation ridges while the bridging portions 16 are aligned with the corrugation dips.

In FIG. 21, two juxtaposed corrugation dips are denoted by references 22*a* and 22*b* and two juxtaposed corrugation crests are denoted by 22*c* and 22*d*. If now the half-honecomb corrugation with the portion 22*a* is folded about the fold line 2 so that the corrugation extends along a perpendicular plane and the strip-shaped region with the portion 22*b* is folded about the fold line 3 so that the half-honeycomb corrugation also extends along a perpendicular plane, the corrugation dips 22*a* and 22*b* touch each other, and a row 23 of hexagonal honeycombs is formed, as correspond to the uppermost row in FIG. 22. In that folding procedure, at the same time the bridging portions 16 are bent back into a horizontal position about the fold line 4 and the half-honeycomb corrugation with the portion 22*d* is folded in such a way that the half-honeycomb corrugations are disposed perpendicularly, in which case the surfaces 22*c* and 22*d* touch each other and can be durably connected together. That results in the second row 24 of cells in FIG. 2, which is displaced with respect to the first row 23, as is the case with octagonal cell-type honeycomb structures.

Accordingly the folded honeycomb structure of FIG. 22, which is provided with bridging portions, is produced by folding corrugation structures in mutually perpendicular directions, and this promises easy manufacture because it can be implemented by rolling.

FIG. 23 shows an embodiment of a blank having U-shaped cuts 9. That arrangement provides for the formation of lugs or tabs which are each subdivided by the fold line 7 or 5 respectively into two lug or tab portions 14, 15 and 17, 18 respectively. The other features correspond to the embodiment shown in FIG. 20. The lug or tab portion 14 is bent downwardly and the lug or tab portion 15 is set horizontally, while the lug or tab portion 17 is bent upwardly and the lug or tab portion 18 is also set horizontally. After the folding operation in two different directions, as described with reference to FIGS. 21 and 22, the lug or tab portions 14 and 17 become respective transverse leg portions which pass through the respective cell 23 and 24 respectively, and the lug or tab portions 15 and 18 become connecting surfaces which extend across the respective cells 23, 24, as is indicated in FIG. 24. The lug or tab portions 15 and 18 afford additional connecting surfaces for a possible sandwich cover layer.

FIG. 25 shows a further possible form of the configuration of the folded honeycomb. The starting material again has U-shaped cuts 9, but the lugs or tabs 14 and 17 formed thereby are not interrupted by fold lines. The lugs or tabs 14 and 17 are bent over perpendicularly upwardly or downwardly, thereby providing stiffening leg portions within the respective cells.

FIG. 26 shows a further possible form of the configuration of the folded honeycomb, and more specifically the lugs or tabs 14, 17 are left in their respective plane 20 or 21. When the lugs or tabs 14, 17 are of a suitable length, they adjoin the bridging portions 13, 16 and can be glued to the edges of the cell walls 22. If the lugs or tabs 14, 17 are of a suitable length, it is also possible for the ends of the lugs or tabs 14 to be concealed beneath the respective adjacent bridging portions 13 in order to ensure that the assembly is naturally held together. The same applies in regard to the ends of the lugs or tabs 17 and the bridging portions 16. Finally, it is also possible for the lugs or tabs 14, 17 to be secured to their respective bridging portions 13, 16 (by gluing or the like) in order to produce a continuous cover layer which extends over the cells and thus strengthens the honeycomb.

FIG. 27 shows a blank for a transition between cells, which are of different heights, of the honeycombs, more specifically a region which tapers in a wedge-like configuration, while FIG. 28 is a diagrammatic view of honeycombs of that kind. As the strips 22 form the cell walls, the strips 22 for cells which increase in height must be wider. If the edges of the cell walls are to be in the boundary surfaces 70, 71 of the wedge shape, then the height of the cell wall of each cell must be lower towards the side of the tip of the wedge, than towards the side at which the wedge increases in size. Therefore the respective width of the strips 22 is variable—also locally, within the strips 22—as can be seen from FIG. 27. The lugs or tabs 14 and 17 are used as additional cover strips and their front free end 15, 18 is fitted under the respective adjacent bridging portion 13 and 16 respectively. The blank shown in FIG. 27 includes some narrow stamping waste portions 72. It will be appreciated that it is also possible for the lugs or tabs 14, 17 to be shortened at their respective free ends, in such a way that they just touch the bridging portions 13, 16, after production of the half-honeycomb corrugations. It will be appreciated that the lugs or tabs 14, 16 can also be glued to the free edges of the cell walls, as is known in relation to the cover layers of sandwich structures.

While, in the previous embodiments, the regions 20 or the regions 21 were each of a respective constant width, it is also possible to vary the width of those regions 20, 21, for example to make the regions 20 of increasing width, with respect to the regions 21 (see FIG. 29). That produces a curvature of the honeycomb transversely with respect to the strip direction (FIG. 30), and the surface portions produced with the honeycomb crest surfaces 20 extend shell-like over the surfaces which are produced by the corrugation trough portions, as is desirable for example in the case of a wing or aerofoil profile at the leading edge thereof.

The following should also be added, in regard to production of the described folded honeycombs.

As the first step, a flat material is supplied, wherein fold lines 1–8 can be impressed therein, although this is not absolutely necessary.

As the second step, the cuts 9 are produced, for example by stamping rollers.

As a third step, the continuous strip-shaped regions 22 are folded in a trapezoidal configuration about the lines 5, 6, 7, 8, in other words the half-honeycomb corrugations with corrugation ridges and corrugation dips are produced. In that procedure, the dimension of the material in the direction of feed conveying movement or in the transverse direction is reduced. Rollers with trapezoidal teeth are used on the top side and the underside of the material, which engage into each other in such a way that the half-honeycomb corrugations are formed. In order to adapt the tool to different widths in respect of the continuous strip-shaped regions 22, it is possible for the rollers to be assembled from individual push-on toothed wheels which are driven from a common splined shaft.

In an intermediate step, activatable adhesive surfaces can be applied in the strips between the fold lines 6, 7 and 8, 5, which constitute the corrugation ridges and the corrugation dips in FIG. 21.

As the next step, the lug or tabs 14 and 15 are bent over, if such are provided and are to be bent over.

As the next step, folding is effected along the continuous fold lines 1, 2, 3 and 4, producing rectangular corrugations, in the corrugation crests or troughs of which the connecting surfaces 13 and 16 respectively come to lie. In that procedure, the material is again reduced in length.

Approximately rectangular corrugations as are produced in manufacture of honeycombs with varying honeycomb heights (FIG. 28) or in the case of curved honeycombs (FIG. 30) are also to be considered as being within the scope of the invention.

As the last step the honeycomb ridges or honeycomb dips of the half-honeycomb corrugations are connected together if a connection of that kind is intended for the structure. Gluing in particular is considered as the appropriate form of connection, but welding and soldering are also possible.

If the corrugation ridges or corrugation dips are not to be glued together, it is also possible for the lugs or tabs 14, 17 to be fixed to the bridging portions in order in that way to guarantee that the honeycomb is certain to be held together.

Prior to the operation of fixing the honeycomb ridges or honeycomb dips to each other or the lugs or tabs to the bridging portions, the structure can be held in the shape which it is finally to assume. The honeycomb then adopts, without internal stresses, for example a shell-like shape which involves many different uses as a core layer for a sandwich structure.

As the production procedure is extensively operated with rollers, the manufacturing costs can be reckoned to be low. Therefore the production of packaging material from paper or cardboard is also envisaged. In comparison with the usual corrugated cardboard, the new packaging material enjoys improved compression or crushing strength and does not bend as easily under flexural loadings. In addition the energy absorption involved under impact or shock loadings is substantially greater, that is to say the suitability of the material as a damping material when transporting packaged goods is improved.

Upon deformation of the folded honeycomb, many leg portions and walls are involved, so that a high level of deformation energy can be absorbed. As a result, the honeycomb is suitable for many crash structures which involve energy dissipation.

FIG. 31 shows a blank comprising material which can be subjected to deep drawing or which can be worked in a similar manner. In particular light metal or alloy can be considered in that respect, but it is also possible for cloth or fiber structures to be permanently deformed out of a layer plane, possibly also in conjunction with the application of heat and moisture (paper, cardboard). The intended deformation is indicated by arrays of fold lines 1, 2, 3, 4 and 5, 6, 7, 8 respectively. Extending along the fold lines 1, 2, 3, 4 are slit-like cuts 9, between which extend strip-shaped regions 20, 21, 22. In regard to the strip-shaped regions 20, the slits 9 are disposed in mutually opposite relationship, and that also applies in regard to the strip-shaped regions 21, but the slit-like cuts 9 of the region 20 are displaced with respect to the slit-like cuts 9 of the region 21. Bridging portions 13 and 16 are provided between the slit-like cuts 9 so that the illustrated web forms a continuous flat body.

The strip-shaped regions 22 are deformed to constitute half-honeycomb corrugations, as is illustrated in FIG. 32. The corrugation dips are denoted by references 22*a* and 22*b* and the corrugation ridges are denoted by references 22*c* and 22*d*. In that respect the strip-shaped regions 20, 21 are aligned with respect to the corrugation ridges or dips respectively. The respective half-corrugations are joined together at the bridging portions 13 and 16 respectively.

To produce the folded honeycomb structure of FIG. 33, the intermediate shape in FIG. 32 is folded about the fold lines 2, 3, 4, 1 in the manner as has been set forth above in the description relating to FIG. 21. Therefore the corrugation dips 22*a* and 22*b* and then the corrugation ridges 22*c* and 22*d* are brought into overlapping relationship with each other and possibly bonded to each other, thus giving the hexagonal honeycomb structure of FIG. 22 as the middle layer in FIG. 33. As nothing has been cut away in the blank shown in FIG. 31, the strip-shaped regions 20, 21 are preserved and cover the hexagonal folded honeycomb structure obtained from the strip-shaped regions 22. That structure in FIG. 33 naturally enjoys a certain stability but a considerable increase in stability can be achieved by bonding of the cut edges to the contact surfaces, and that is therefore preferred.

Depending on the respective material from which the folded honeycomb shown in FIG. 33 is produced, it is suitable as a lightweight structure, as packaging material or as a crash structure.

What is claimed is:

1. A folded honeycomb formed from a plurality of similar cells arranged in rows, having the following features:

the cells have lateral cell walls which adjoin each other in an annular configuration to form cell openings;

transversely relative to the cell walls, the cells are delimited by honeycomb boundary planes in which the openings of the cells lie;

the folded honeycomb is folded from a continuous flat blank of web material provided with cuts (9) to form strip-shaped regions (20, 21, 22);

characterized by the following features:

the strip-shaped regions are subdivided into a first plurality (22) of strip-shaped regions and into a second plurality (20, 21) of strip-shaped regions which alternate over the flat blank;

the second strip-shaped regions (20, 21) have bridging portions (13, 16) which connect the respectively adjacent first strip-shaped regions (22) together;

the first strip-shaped regions (22) are folded through about 900 relative to the second strip-shaped regions (20, 21), wherein the bridging portions (13, 16) come to lie in the planes in which the openings of the cells lie and partially or completely bridge over said openings.

2. A folded honeycomb as set forth in claim 1, further characterized in that:

the first strip-shaped regions (22) are folded along pleatings to form half-honeycomb corrugations with honeycomb ridges (22*c*, 22*d*) and honeycomb dips (22*a*, 22*b*) the honeycomb ridges and the honeycomb dips each having flat portions;

adjacent half-honeycomb corrugations touch each other with said flat portions of their corrugation ridges or corrugation dips in order to form a respective row of cells; and each bridging portion (13, 16) bridges over an a cell.

3. A folded honeycomb as set forth in claim 2 further characterized in that the honeycomb ridges (22*c*, 22*d*) or the honeycomb dips (22*a*, 22*b*) are durably connected together.

4. A folded honeycomb as set forth in claim 2 further characterized in that the pleatings of the first strip-shaped regions (22) are uniform and four pleatings (5, 6, 7,8) form a period.

5. A folded honeycomb as set forth in claim 4 further characterized in that the bridging portions (13, 16) are arranged on the second strip-shaped regions (20, 21) in periods corresponding to the pleatings (5, 6, 7, 8) of the first strip-shaped regions (22).

6. A folded honeycomb as set forth in claim 4 characterized in that the cuts (9) in the second strip-shaped regions (20, 21) extend three quarters of a period.

7. A folded honeycomb as set forth in claim 1 characterized in that the cuts (9) are rectangular.

8. A folded honeycomb as set forth in claim 2 characterized in that the cuts (9) are U-shaped and form tabs (14,17).

9. A folded honeycomb as set forth in claim 8 further characterized in that the half honeycomb corrugations have crests that lie in a plane and troughs that lie in a plane and the tabs (14, 17) lie in one of the corrugation crest plane (2) and the corrugation trough plane (21).

10. A folded honeycomb as set forth in claim 8 characterized in that the tabs (14, 17) are folded out of their respective corrugation crest plane or corrugation trough plane.

11. A folded honeycomb as set forth in claim 10 characterized in that the free ends (15, 18) of the lugs or tabs (14, 17) are folded into the local corrugation trough plane or corrugation crest plane.

12. A folded honeycomb as set forth in claim 1 characterized in that the cuts (9) are of slit-like shape so that the second strip-shaped regions (20, 21) arc uninterrupted.

13. A folded honeycomb as set forth in claim 12 characterized in that the slit-shaped cuts (9) are disposed in opposite relationship in pairs on the second strip-shaped regions (20, 21) and pairs of slits of adjacent second strip-shaped regions (20, 21) are displaced relative to each other.

14. A folded honeycomb as set forth in claim 1 characterized in that the strip width of the first strip-shaped regions (22) varies in accordance with a predetermined local layer thickness of the folded honeycomb.

15. A folded honeycomb as set forth in claim 2 characterized in that the strip width of the second strip-shaped regions forming crests (20) of the corrugations and troughs (21) of the corrugations are selected to be different in order to afford local curvatures of the folded honeycomb.

16. A folded honeycomb as set forth in claim 1 further characterized in that:

the cells are defined by boundary planes parallel with the rows;

the cell walls are formed by two series of side leg walls (14, 17, 22; 44, 50, 51, 52);

a first series of side leg walls (22; 44, 52) extends on average in a first direction;

a second series of side leg walls (14, 17; 50, 51) extends in a second direction transversely with respect to the first direction;

the side leg walls (14, 17, 22; 44, 50, 51, 52) are delimited by cut edges (11, 12; 41, 42) and fold edges (5, 6, 7, 8; 35, 36) of the flat blank;

a first group of connecting surfaces (13, 15; 43, 46) is formed by the bridging portions which have remained in the honeycomb boundary planes and which are delimited by three fold edges (1, 2, 3, 4, 5, 6; 31, 32, 33, 34, 35, 36) and a cut edge (10; 40).

17. A folded honeycomb as set forth in claim 16 further characterized in that a second group of connecting surfaces (16, 18; 45, 48) is formed by folded portions of the flat blank, which are folded into the honeycomb boundary plane and which are delimited by at least two cut edges (10, 11, 12; 40, 41, 42).

18. A folded honeycomb as set forth in claim 16 further characterized in that a third group of connecting surfaces (27) is formed by portions of the flat blank, which are folded from the side leg walls into at least one honeycomb boundary plane and which extend transversely to the first or second group of the connecting surfaces.

19. A folded honeycomb as set forth in claim 16 characterized in that cut edges (11, 12; 40) which are in contact with side leg walls are connected thereto by adhesive, soldering or welding.

20. A folded honeycomb as set forth in claim 16 further characterized in that the flat blank is folded along continuous fold lines (1, 2, 3, 4) into rectangular corrugations which form a plurality of corrugation crest surfaces and corrugation trough surfaces from the second strip shaped-regions (20, 21) and the first series of the side leg walls from the first strip-shaped regions (22), the cuts (9) in the flat blank for forming the second series of the side leg walls are of a U-shaped configuration defining tabs, wherein the cut edges (11, 12) extend in accordance with the limbs of the U-shape at an acute angle and the cut edge (10) extends in accordance with the base of the U-shape transversely with respect to the continuous fold lines (1,2,3,4), the U-shaped cuts (9) are arranged in rows along at least one of the corrugation crest surfaces (20) and the corrugation trough surfaces (21) at such spacings that the first group of the connecting surfaces (13, 16) is formed thereby, and the side leg walls of the second side are folded out of the respective plane of the at least one of the corrugation crest and the corrugation trough along tab fold lines (5 6) into the honeycomb.

21. A folded honeycomb as set forth in claim 20 characterized in that the tabs within the U-shaped cuts (9) are bent over at their free ends to form tongue surfaces which form the second group of connecting surfaces (16, 18).

22. A folded honeycomb as set forth in claim 20 characterized in that the tab fold lines (5) of adjacent rows of the U-shaped cuts (9) are aligned with each other.

23. A folded honeycomb as set forth in claim 20 characterized in that the tab fold lines (5, 6) of adjacent rows of the U-shaped cuts (9) are displaced relative to each other.

24. A folded honeycomb as set forth in claim 23 characterized in that the side leg walls of the first series are deformed transversely to the plane thereof.

25. A folded honeycomb as set forth in claim 24 characterized in that mutually oppositely disposed side leg walls are deformed away from each other to form hexagonal folded honeycombs.

26. A folded honeycomb as set forth in claim 24 characterized in that mutually oppositely disposed side leg walls are deformed towards each other to form a fish joint pattern.

27. A folded honeycomb as set forth in claim 24 characterized in that the side leg walls of the first series are deformed in a stepped configuration in order to bear against the side leg walls of the second series.

28. A folded honeycomb as set forth in claim 16 characterized in that:

the strip-shaped regions of the flat blank are subdivided into narrower and wider strips (55, 56, 57, 58) which are separated from each other by fold edges (35, 36) and cut edges (37, 39), wherein the cut edges form interrupted meander portions, the narrower strips (55, 57) form rectangular corrugations in planes perpendicularly to the longitudinal extent of the folded honeycomb, wherein surfaces (43, 48) of the corrugation crests or surfaces (45, 46) of the corrugation troughs of adjacent narrow strips (55, 57) alternately represent the first (43, 46) or the second (45, 48) group of connecting surfaces and flank surfaces (44) form a part of the first series of the side leg walls, and the wider strips (55, 58) form rectangular corrugations in the plane of the folded honeycomb, wherein surfaces (SO) of the corrugation crests and surfaces (51) of the corrugation troughs represent the second series of the side leg walls while flank surfaces (52) together with the flank surfaces (44) of the narrower strips (55, 57) form the first series of the side leg walls.

29. A folded honeycomb as set forth in claim 28 characterized in that the corrugation crest surfaces (43, 48) or corrugation trough surfaces (45, 46) of the narrower strips (55, 57) are half as wide as the flank surfaces (44).

30. A process for the production of a folded honeycomb formed from a plurality of similar cells arranged in rows by folding a continuous flat blank of web material provided with cuts to form strip-shaped regions, comprising the following steps;

a) providing a web material b) cutting the web material to size wherein there is produced a flat blank and in that operation, cuts (9) are provided to form first strip-shaped regions (22) and second strip-shaped regions (20, 21) which alternate with each other, cuts (9) being provided in the second strip-shaped regions (20, 21) between which bridging portions (13, 16) remain the bridging portions (13, 16) connecting together the first strip shaped regions (22);

c) deforming the first strip-shaped regions (22) transversely with respect to the strip direction in order to provide half-honeycomb corrugations with corrugation ridges (22*c*, 22*d*), and corrugation dips (22*a*, 22*b*) on which flat portions are formed;

d) folding the flat blank which is deformed in the first strip-shaped regions (22) into rectangular corrugations along fold lines (1, 2, 3, 4) which separate the first and second strip-shaped regions (20, 21, 22) from each other, wherein the bridging portions come to lie in crests or troughs of the corrugations; and e) contacting the flat portions of the corrugation ridges (22*c*, 22*d*) or corrugation dips (22*a*, 22*b*) into relationship with oppositely disposed flat portions of the conjugation dips (22*a*, 22*b*) or corrugation ridges (22*c*, 22*d*).

31. A process as set forth in claim 30 further characterized in fixedly connecting brought into contacting relationship are the corrugation ridges (22*c*, 22*d*) and the corrugation dips (22*a*, 22*b*) of the half-honeycomb corrugations to each other.

32. A process as set forth in claim 30 further characterized in deforming by bending or folding of the first strip-shaped regions (22).

33. A process as set forth in claim 30 further characterized in deforming by deep-drawing of the first strip-shaped regions (22).

34. A process for the production of a folded honeycomb layer formed from a plurality of similar cells arranged in rows by folding a flat blank of web material comprising the steps:

a) providing a web material;

b) cutting the web material into cuts (9) first strip-shaped regions (22) and second strip-shaped regions (20, 21) which alternate with each other, cuts (9) providing in the second strip-shaped regions (20, 21) between which bridging portions (13, 16) remain connecting together the bridging portions (13, 16) and the first strip shaped regions (22); the cuts 9 being U-shaped cuts (9) in rows in order to prepare flat blanks with side leg walls (14, 17) of a second series which are separated from each other by the bridging portions (13, 15) which form connecting surfaces of a first group, wherein cut edges (11, 12) along the limbs of the U-shape extend in accordance with the limbs of the U-shape at an acute angle or coincidentally with continuous fold lines (I, 2, 3, 4) to separate the first strip-shaped regions (22) from the second strip-shaped regions (20, 21) and a further cut edge (10) extends in accordance with the base of the U-shape transversely with respect to the continuous fold lines (I, 2, 3, 4);

(c) the flat blanks are folded into rectangular corrugations along the continuous fold lines (I, 2, 3, 4) in order to form corrugation crest surfaces and corrugation trough surfaces with the second strip-shaped regions (20, 21) and leg walls of a first series with the first strip-shaped regions (22);

e) folding the side leg walls (14, 17) of the second series out of the respective plane of the corrugation crest or the corrugation trough respectively into the folded honeycomb layer along lug fold lines (5, 5) wherein the bridging portions (13, 16) remain in said corrugation crest or corrugation trough planes respectively.

35. A process as set forth in claim 34 characterized in sending the ends of the side leg walls (14, 17) over to form tongue surfaces (15, 18) which form a second group of connecting surfaces.

36. A process as set forth in claim 34 further characterized in disposing the U-shaped cuts (9) in the rows so that the lug fold lines (5) of the side leg walls (14, 17) of adjacent rows are mutually aligned.

37. A process as set forth in claim 34 further characterized in disposing the U-shaped cuts (9) in the rows so that the lug fold lines (5, 6) of the side leg walls (14, 17) of adjacent rows are mutually displaced.

38. A process as set forth in claim 34 further characterized in fixedly connecting the cut edges (11, 12) of the limbs of the U-shape are to the leg side walls formed from the first strip-shaped regions (22) along prepared connecting locations (19).

39. A process as set forth in claim 38 further characterized in deforming the leg walls formed from the first strip-shaped regions (22) of the first series transversely to the plane thereof to form hexagonal folded honeycombs.

40. A process as set forth in claim 38 further characterized in deforming that the leg walls formed from the first strip-shaped regions (22) of the first series transversely with respect to the plane thereof to form fish joint patterns.

41. A process as set forth in claim 38 characterized in deforming that the leg walls formed from the first strip-shaped regions (22) of the first series transversely with respect to the plane thereof to form stepped edges which partially bear against the side leg walls (14, 17) of the second series.

42. A process for the production of a folded honeycomb formed from a plurality of similar cells arranged in rows and formed from a flat blank of web material comprising the steps:

a) providing a web material;

b) providing the web material with meander cuts (37, 39) to form flat blanks, wherein the meander cuts (37, 39) are displaced relative to each other and the flat blanks are subdivided along first fold lines (35, 36) into narrower and wider strips (55, 56, 57, 58);

c) folding the flat blanks are folded in mutually overlapping relationship along the first fold lines (35, 36) to form an overlapping structure;

d) deforming the overlapping structure along second fold lines (31, 32, 33, 34) which extend perpendicularly to the first fold lines (35, 36) to constitute rectangular corrugations so that the narrower and wider strips (55, 55, 57, 58) form individual rectangular corrugations which are inserted one into the other; and e) pulling apart the rectangular corrugations which are inserted one into the other, in which case the narrower strips (55, 57) are arranged with their rectangular corrugations in planes perpendicularly to the plane of the folded honeycomb and the wider strips (56, 58) are arranged with their rectangular corrugations in the plane of the folded honeycomb.

43. A process as set forth in claim 42 further characterized in placing the narrower strips and wide strips have flank surfaces and the flank surfaces (44) of the rectangular corrugations of the narrower strips (55, 57) into alignment or in slightly overlapping relationship with the flank surfaces (52) of the wider strips (56, 58) and are fixedly connected thereto to form a first series of side leg walls (44, 52).

44. A folded honeycomb as set forth in claim 1 wherein said honeycomb web material for use as packaging material is of conventional paper or cardboard.

45. A process according to claim 36, wherein the side leg walls formed from the first strip-shaped regions (22) are deformed transversely relative to the strip direction.

46. The folded honeycomb as set forth in claim 1, characterized in that the folded honeycomb is a sandwich core layer.

47. A process according to claim 31, wherein the web material is at least one of metal, plastic material, cloth, fiber composite material, fiber reinforced paper or conventional paper or cardboard.

48. A process according to claim 36, characterized in that the web material is at least one of metal, plastic material, cloth, fiber composite material or fiber reinforced paper, optionally with prepared adhesive, solder or welded connecting locations (19), which are to be arranged in line the with lug fold lines (5, 5).

* * * * *